US006966324B2

(12) United States Patent
Guido

(10) Patent No.: US 6,966,324 B2
(45) Date of Patent: Nov. 22, 2005

(54) CLEAT FOR A TENT

(76) Inventor: Anthony L. Guido, 510 N. Davis Rd., Elma, NY (US) 14059

( * ) Notice: Subject to any disclaimer, the term of this patent is extended or adjusted under 35 U.S.C. 154(b) by 0 days.

(21) Appl. No.: 10/420,583

(22) Filed: Apr. 22, 2003

(65) Prior Publication Data

US 2004/0211453 A1 Oct. 28, 2004

(51) Int. Cl.[7] ..... E04H 15/32

(52) U.S. Cl. ..... 135/120.4; 135/118; 24/265 AL; 24/200

(58) Field of Search ..... 135/87, 116, 118, 135/119, 120.1, 120.2, 120.3, 120.4; 24/265 BC, 24/265 AL, 198, 199, 200

(56) References Cited

U.S. PATENT DOCUMENTS 1,053,255 A * 2/1913 Ward ..... 248/536
3,223,098 A * 12/1965 Dole, Jr. ..... 135/126
4,038,727 A * 8/1977 Robbins ..... 24/461
4,782,846 A * 11/1988 Ting ..... 135/120.3
5,036,874 A * 8/1991 Lynch ..... 135/99
5,333,634 A * 8/1994 Taylor ..... 135/98
5,345,962 A * 9/1994 Moss ..... 135/124
5,615,699 A * 4/1997 Lee ..... 135/118
5,884,646 A * 3/1999 Ju ..... 135/135
5,918,614 A * 7/1999 Lynch ..... 135/95
5,954,077 A * 9/1999 Wain et al. ..... 135/119
6,092,342 A * 7/2000 Sharapata ..... 52/298
6,219,888 B1 * 4/2001 Lynch ..... 24/115 R
6,681,786 B2 * 1/2004 Ju ..... 135/120.3
2001/0014997 A1 * 8/2001 Suzuki et al. ..... 24/265 R

* cited by examiner

*Primary Examiner*—Jonathon Szumny
(74) *Attorney, Agent, or Firm*—Hodgson Russ LLP

(57) ABSTRACT

A cleat comprising a body comprising a first portion and that defines a web cutout and a tent pole cutout, and a second portion that defines a guy rope cutout, and the body comprising a bend where the first portion and the second portion meet. The cleat is made of steel or other non-cast metal, and can withstand loading imposed by humans and ratchets without failing. In an embodiment, the first portion comprises a rectangular shape and the second portion comprises a trapezoidal shape, and the first portion and the second portion meet at a bend. The cleat further comprises a web wrapping portion formed adjacent to the web cutout, and a clip is provided. The clip is received in the web cutout and fitted about the web wrapping portion, the clip for preventing a canopy web of a tent from wearing out when the cleat is attached to the canopy web.

4 Claims, 11 Drawing Sheets

CLEAT FOR A TENT

BACKGROUND

Tents have been used as a means for providing shelter for many years, and come in a vast number of configurations. Some tents have canopies, sidewalls, and floors, making them substantially wind and water tight. Other tents are open air, having only a canopy. There are also the small "pop-up" tents which are frequently used by people camping.

Larger tents, for example those used at weddings, picnic groves, military installations, and at outdoor events, may cover an area of several hundred square feet to many thousands of square feet. For these larger tents, the loads imposed by wind, rain, snow, and ice require the tent and its components to have increased structural strength. One of the structural components used to support the tent is the cleat, the cleat being the piece that connects with the tent canopy, the tent post, and the guy ropes/wires. The cleat thus experiences loading from the following: the guy wire, the post, and the canopy. In the past, these cleats were made of cast metal which is very prone to snapping and unpredictably failing.

Additionally, after a tent is erected, the tent will sway in the wind, and it will flex under rain, snow, and ice loads. Over time, this constant motion causes the guy ropes to loosen, and this causes the tent to sway even more. Eventually, the tent will collapse, unless the guy ropes are constantly re-tightened. To draw the slack out of the guy ropes, crews of workers pull on the ropes and the slack is wrapped around the ground stake, and/or the ground stake is pounded deeper into the ground. This process not only calls for multiple workers, but takes a good deal of time and must be frequently repeated.

Recently, ratchets have been used to speed up the process of taking the slack out of guy ropes. This is accomplished by installing a ratchet in a guy rope line, and providing the ratchet with a ratchet handle. One person, by moving the ratchet handle back and forth, can draw the desired amount of slack out of the guy rope, and this saves on time and expense. However, the use of ratchets has caused new problems.

First, the person operating the ratchet has no indication of the amount of the load being imposed on the guy rope. Because of the mechanical advantage that can be achieved with a ratchet, a single person can now place a load on a guy wire equivalent to ten or more people pulling on the guy rope. The enormous loading that can be imposed by the ratchet typically causes something to break, and most frequently it is the cleat or tent bracket (hereinafter cleat) that snaps or fails.

There are several reasons the cleats presently in use fail. One of them is the fact that cleats presently in use were never designed to withstand the loading imposed by a ratchet. Another is the fact that the worker operating the ratchet has no idea of how much stress is being applied to the guy wire and cleat, and thus does not know when to stop ratcheting.

Yet another reason that cleats currently in use fail is because they are made of cast metal. Cast metal is poured into a die or mold and cooled. However, as cooling occurs, the outside edges of the cast piece cool and solidify first, while the center remains liquid. As the piece continues to cool, the liquid continues to shrink as it solidifies. This thus causes the cast piece to be, by its very nature, porous and prone to failure. This porosity weakens the piece, and this is one of the explanations that cast metal cleats are prone to snapping when placed under the loads imposed by the ratchet.

Thus, there is a need for a cleat that can withstand loading without snapping. There is also a need for a cleat that can safely withstand the loads imposed by the ratchet without the cleat snapping and breaking.

SUMMARY

The present cleat overcomes the problems associated with cast cleats used up until now. The cleat comprises a body comprising a first side wall and a second side wall, with a surrounding side wall extending between the first side wall and second side wall. The surrounding side wall extends about the periphery of the body. The body further comprises a first portion that defines a web cutout and a tent pole cutout, and a second portion that defines a guy rope cutout. The body further comprises a bend where the first portion and the second portion meet. At the bend, the first portion and the second portion are folded towards one another and make between about a 145 to about a 165 degree angle relative to one another.

The first portion is rectangular shaped and the second portion is trapezoidal shaped. The cleat comprises cold rolled steel, stainless steel, and steel alloys. The cleat is made of a non-cast metal, which provides the cleat with strength, and at the same time significantly reduces the possibility the cleat will fail when used in tent applications.

The body further comprises a web wrapping portion formed adjacent to the web cutout. A clip is provided and is received in the web cutout and fitted about the web wrapping portion. The clip, which may comprise plastic, metal, or combinations thereof, is for preventing the canopy web of the tent from wearing out when the cleat is attached to the canopy web.

The cleat is made by providing a sheet of steel, which may be cold rolled steel. A stamping machine stamps a web cutout, a tent pole cutout, and a guy rope cutout in the sheet of steel, and the rectangular and trapezoidal shapes are also stamped into the sheet of steel. Next, the sheet of steel is bent in a steel bending machine and formed into the body, the body comprising a first portion and a second portion that meet at a bend. The first portion comprises the tent pole cutout and the web cutout, and the second portion comprises the guy rope cutout. The first portion and second portion are not coplanar after bending. The body is bent to an extent that the first portion and second portion are at an angle of between 145 degrees to 165 degrees relative to one another.

The cleat is installed in the canopy web by placing the canopy web through the web cutout defined in the cleat. A clip is provided to separate the canopy web from the cleat, and this prevents the canopy web from wearing out against the cleat. As the tent loosens over time, a worker need only move the handle of the ratchet that is installed in the guy rope line to remove slack. Thus, because the cleat is made of durable steel and has a bend, under normal use it will not snap or break when the worker uses the ratchet to draw up slack from the line, even if the worker places excessive tension in the guy rope.

DESCRIPTION

Figure 7:
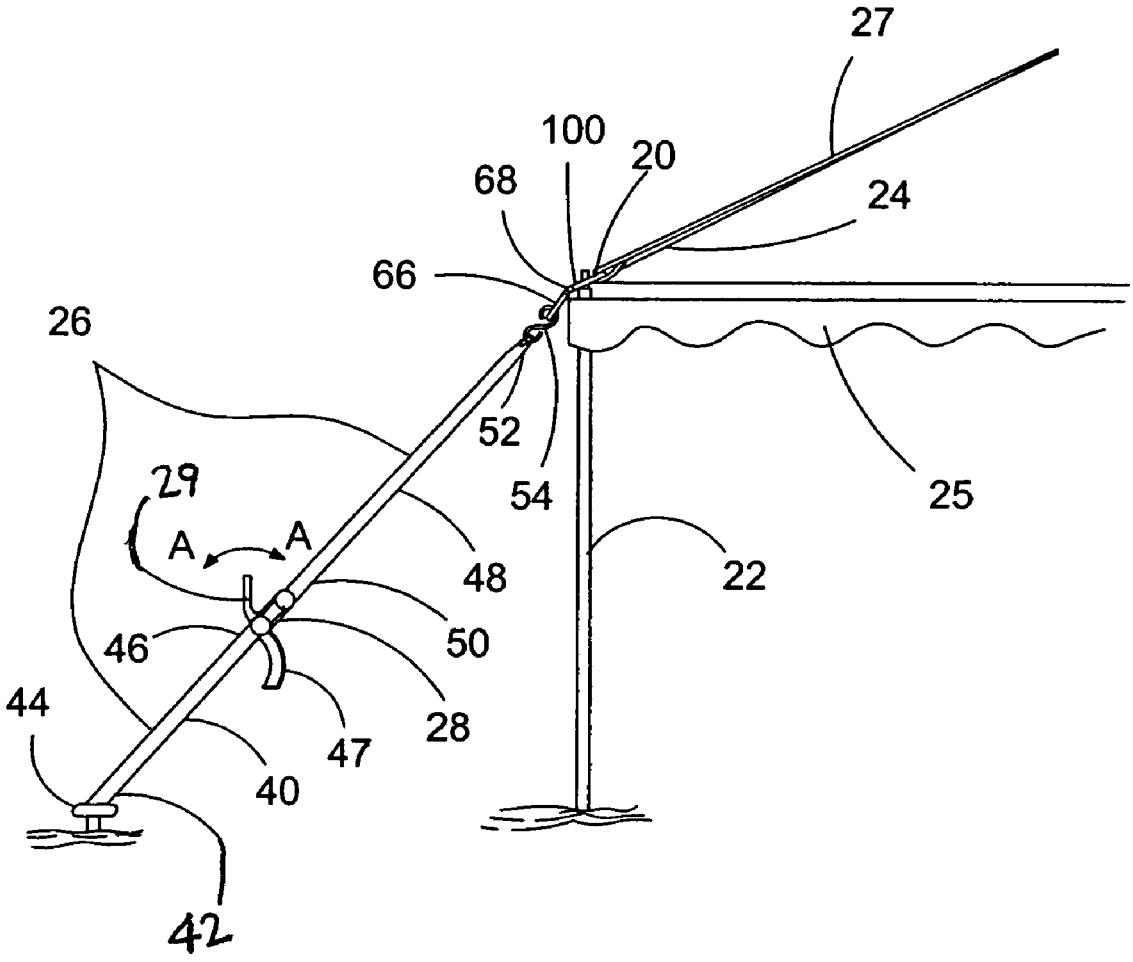
FIG. 7 shows a diagrammatic view of the cleat installed in an erected tent.
Figure 8:
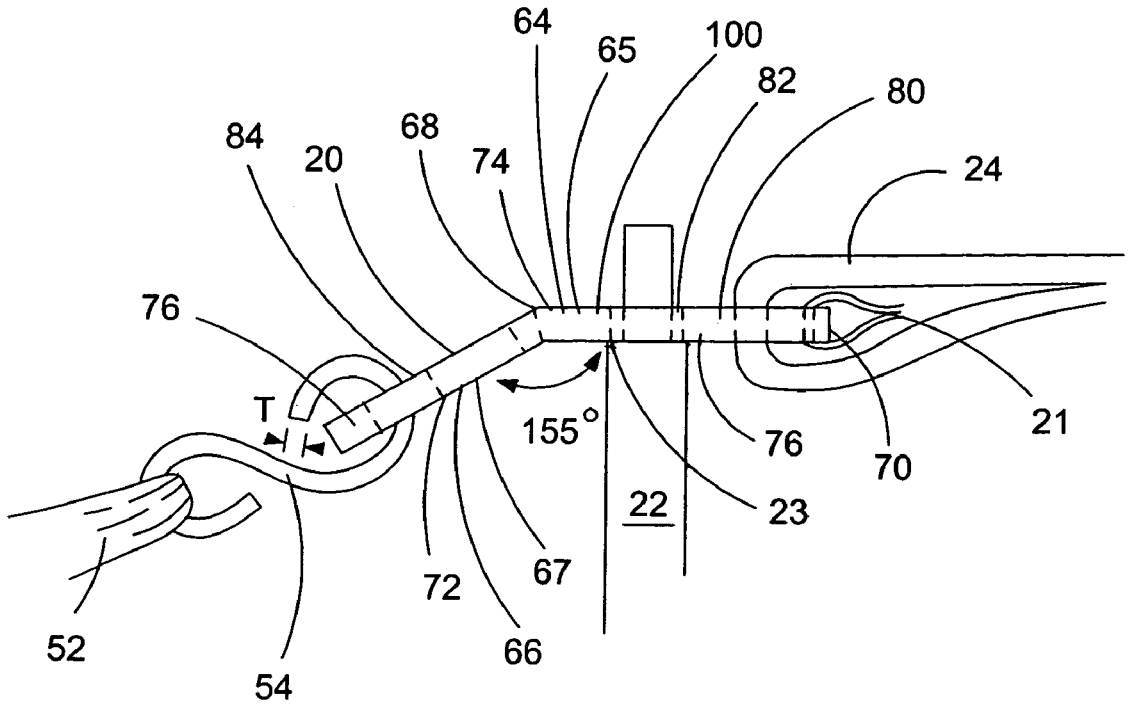
FIG. 8 shows an exploded view of the cleat, guy rope, pole and tent web connection of FIG. 7.

The cleat 20 is shown in FIGS. 1–6 and it overcomes many of the problems associated with the cleats used in the past, because the structure of the cleat 20 allows it to withstand very heavy loads without failing. FIG. 7 shows a diagrammatic view of the cleat 20 installed in a tent 25, and FIG. 8 shows an exploded view of FIG. 7. The cleat 20 can safely handle the combined loads imposed by the guy rope/wires 26 (hereinafter guy rope 26) as slack is removed from the guy rope 26 by the ratchet 28, the canopy 24, and the tent pole 22. Hence, the chances the cleat 20 will snap when the ratchet 28 (FIG. 7) is used to take slack out of the first rope 40 (FIG. 7) are greatly decreased. The cleat 20 comprises cold rolled steel, and comprises a thickness, designated T in the figures, of about three millimeters to about seven millimeters, or in other embodiments about 0.188 inches thick. Of course, in other embodiments, the cleat 20 may comprise an even greater thickness to support more massive tents. The cleat 20 may also comprise stainless steel, steel alloys, suitable metal alloys, and other suitable non-cast metals. The cleat 20 may be coated with yellow zinc plating. The cleat 20 comprises a length (designated L in FIG. 3) that may be about 3.88 inches and further comprises a width (designated W in FIG. 3) that may be about 3.00 inches. These dimensions may be different in other embodiments of the cleat 20.

Turning now to FIGS. 7 and 8, shown therein are views of the cleat 20 installed in a tent 25. In particular, the cleat 20 connects to the tent pole 22, the canopy web 24, and the guy rope 26. The guy rope 26 comprises a first rope 40 having a first end 42 connected to a ground stake 44, and a second end 46 fed into and through the ratchet mechanism 28 (ratchet 28). The guy rope 26 further comprises a second rope 48 comprising a ratchet end 50 attached to the ratchet 28, and a hook end 52 comprising a hook 54, the hook 54 for hooking to the cleat 20. To remove slack from the guy rope 26 in a tent 25 that is standing, the user need only move the handle 29 of the ratchet 28 back and forth in the direction indicated by arrows A—A in FIG. 7. This causes the first rope 40 to be fed through the ratchet 28, and in doing so removes slack from the guy rope 26. The taken-up slack rope is indicated by reference number 47 in FIG. 7. As the ratchet 28 is operated, the loads on the cleat 20 increase significantly. The second rope 48 is hooked to the cleat 20 and attached to the ratchet 28, but is not fed through the ratchet 28 as is the case with the first rope 40.

The structure of the cleat 20 provides for the strength required to withstand the loads imposed by the ratchet 28. Shown in FIGS. 1–6 are views of the cleat 20 and the web preserving clip 21, the utility of the web preserving clip 21 (hereinafter clip 21) to be described presently. The cleat 20 comprises a body 100. The body 100 comprises a first side wall 72, a second side wall 74, and a surrounding side wall 76 that extends between the first side wall 72 and second side wall 74. The surrounding side wall 76 extends along the periphery of the body 100, and comprises a thickness designated T. The thickness T is about three millimeters to about seven millimeters, or in a particular embodiment, the thickness of the cleat 20 may be about 0.188 inches. In other embodiments, thickness T could be greater or lesser.

Figure 4:
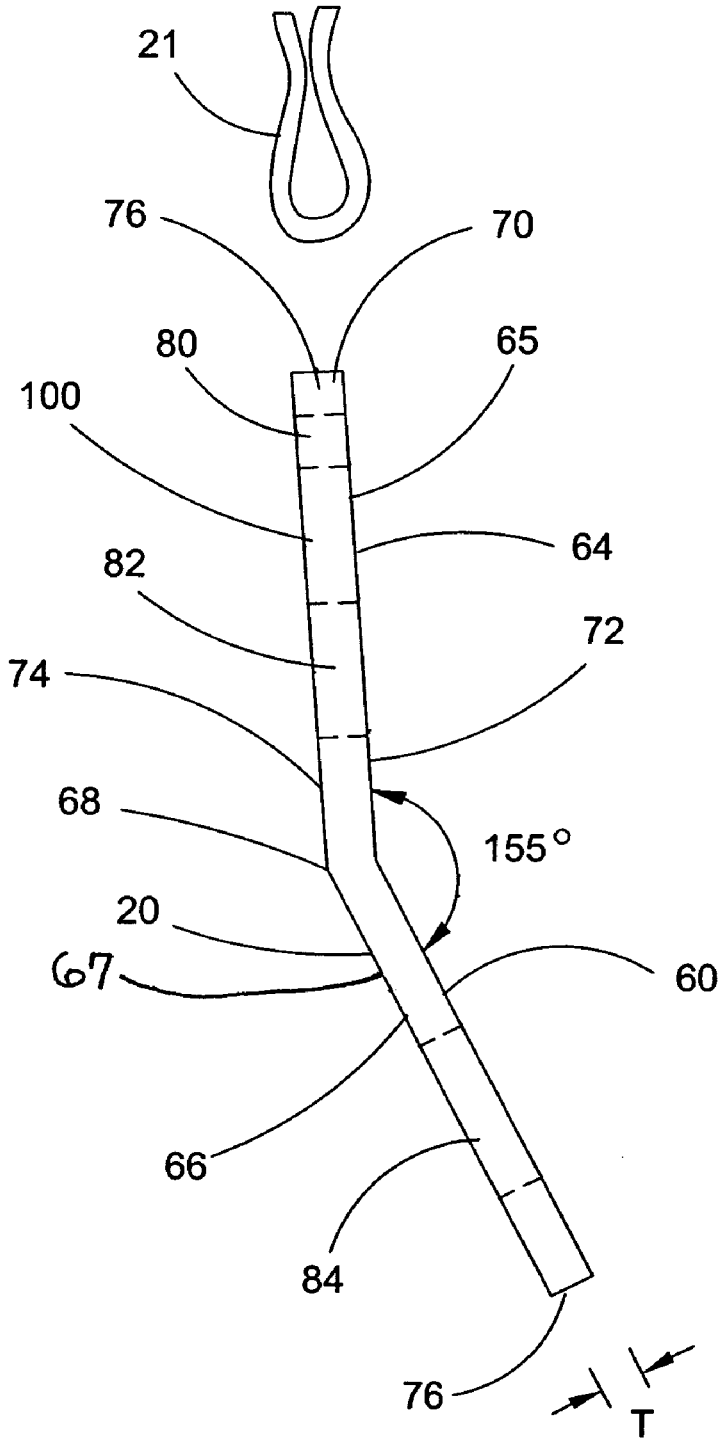
FIG. 4 shows a side elevational view of the clip and the cleat.
Figure 5:
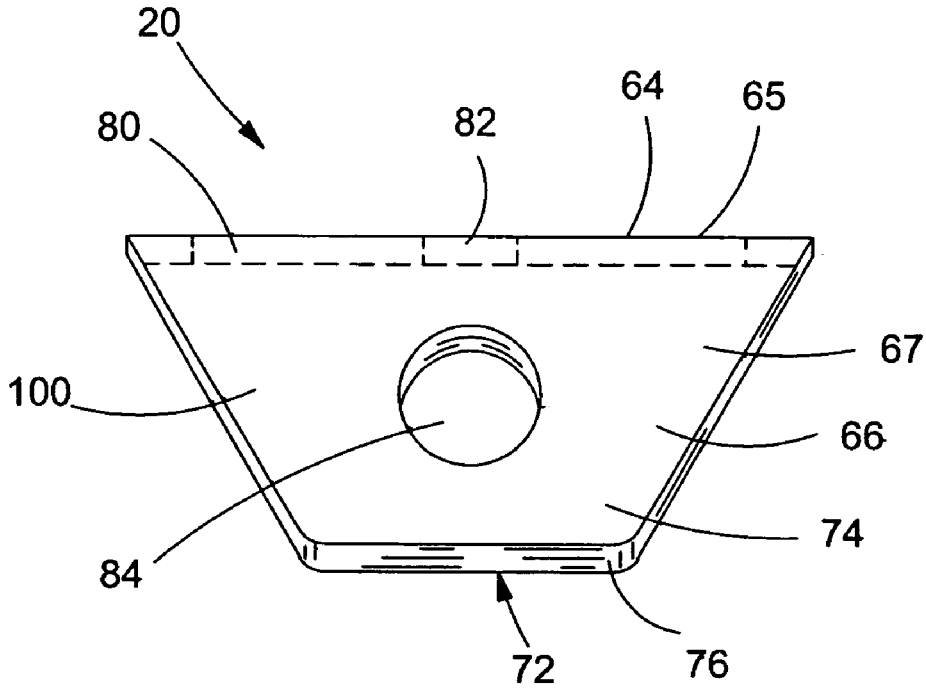
FIG. 5 shows a front elevational view of the cleat.
Figure 6:
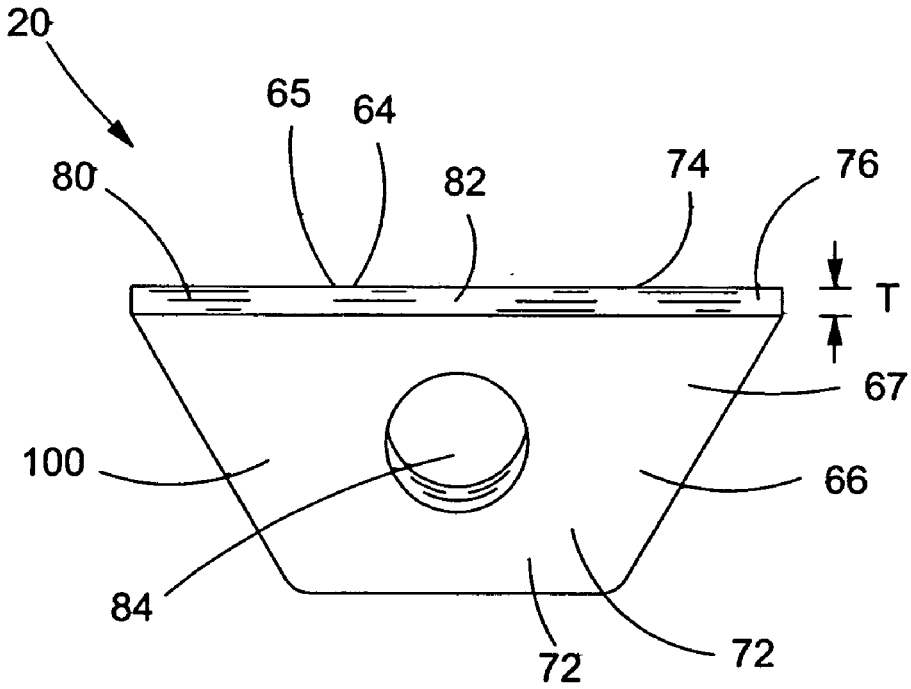
FIG. 6 shows a rear elevational view of the cleat.

A bend 68 is formed in the first side wall 72, the second side wall 74, and the surrounding sidewall 76. At the bend 68, the body 100 is shaped into a first portion 64 comprising a substantially rectangular shape 65 and a second portion 66 comprising a substantially trapezoidal shape 67. Of course, in other embodiments, the first portion 64 and second portion 66 could comprise other shapes. For example, the second portion 66 could have a rectangular shape instead of the trapezoidal shape 67. It is noted that at the bend 68, the first side wall 72 is partly folded in upon itself, as shown in FIGS. 4 and 8. That is, the trapezoidal shaped 67 second portion 66 makes an angle with respect to the rectangular shaped 65 first portion 64, as shown in FIGS. 4 and 8. This angle may be about 155 degrees. It is to be understood that the angle the first and second portions 64, 66 respectively, make with one another could be otherwise embodied, and this angle could be about 145 degrees to about 165 degrees.

Figure 1:
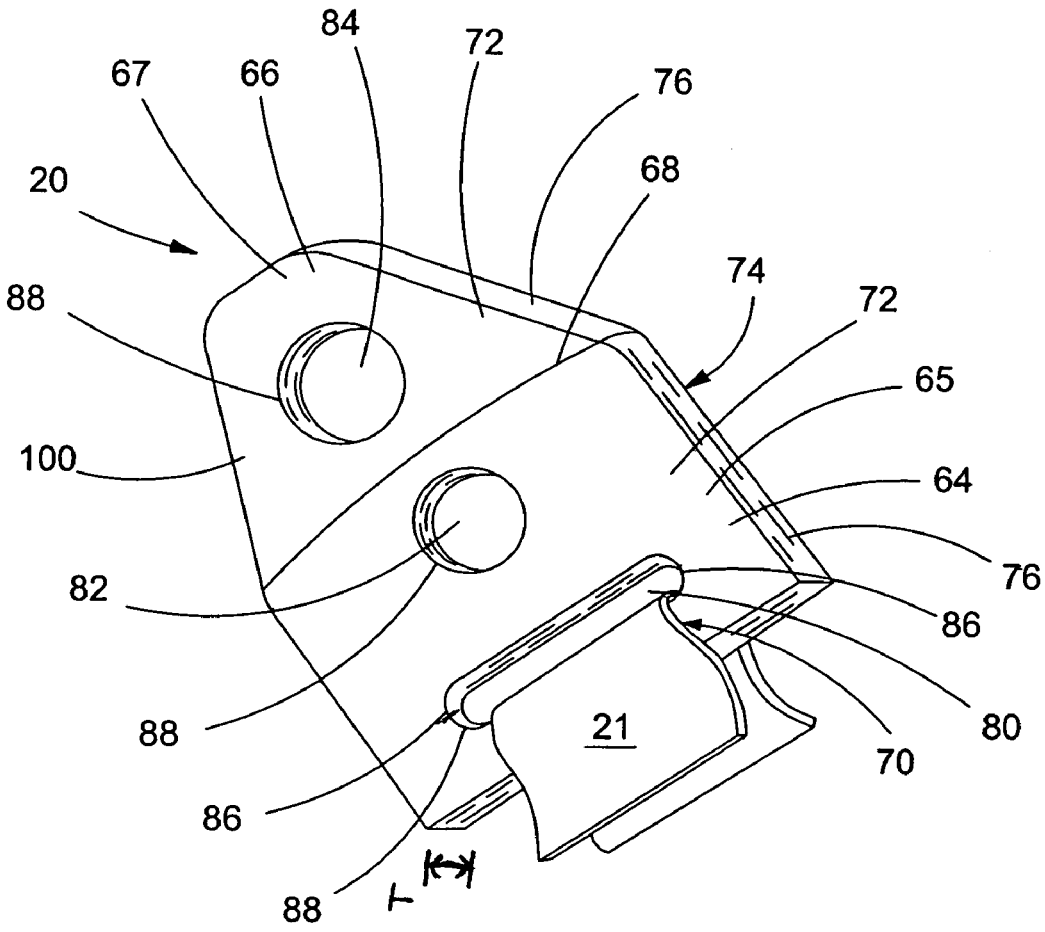
FIG. 1 shows a perspective view of the cleat and clip member joined together.
Figure 2:
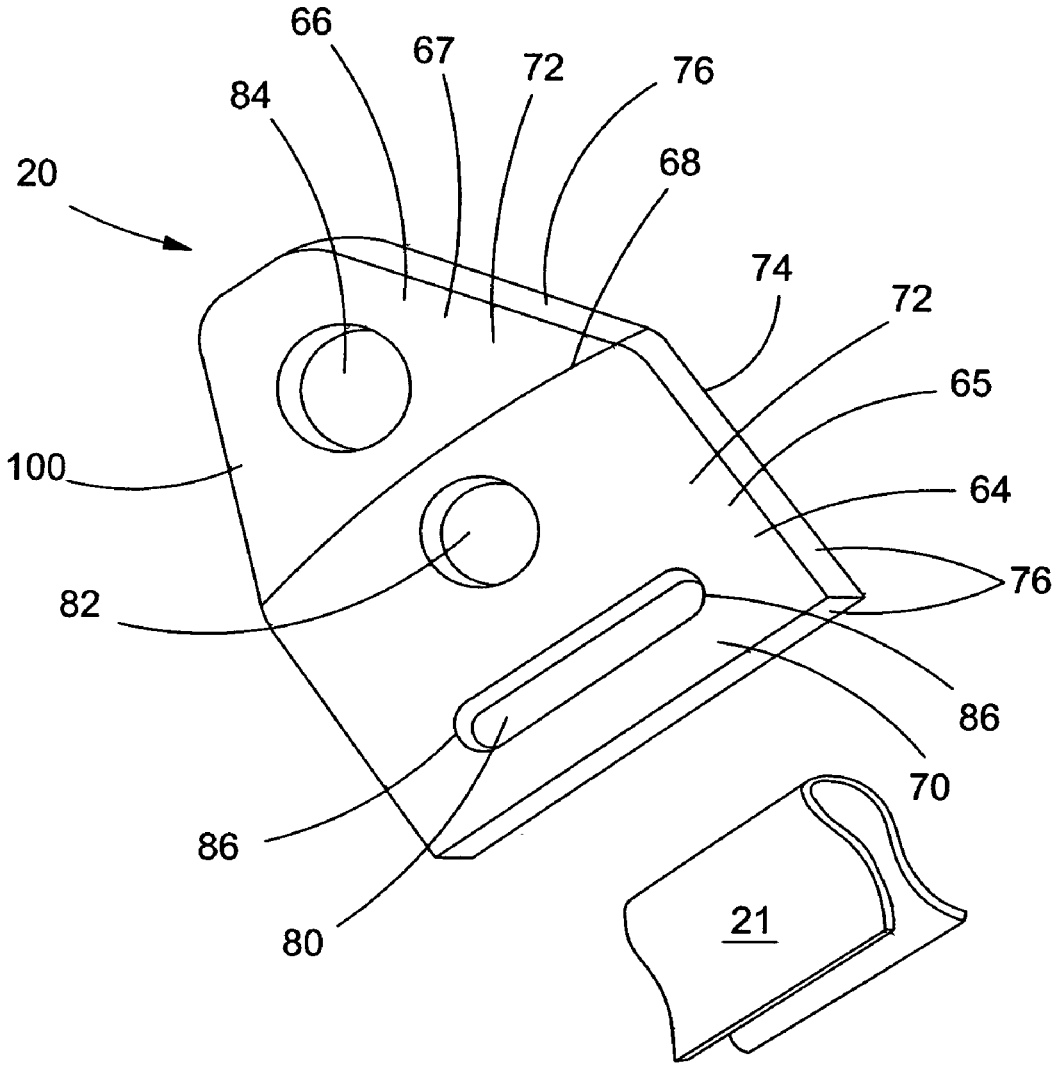
FIG. 2 shows a perspective view of the cleat and clip member separated.
Figure 3:
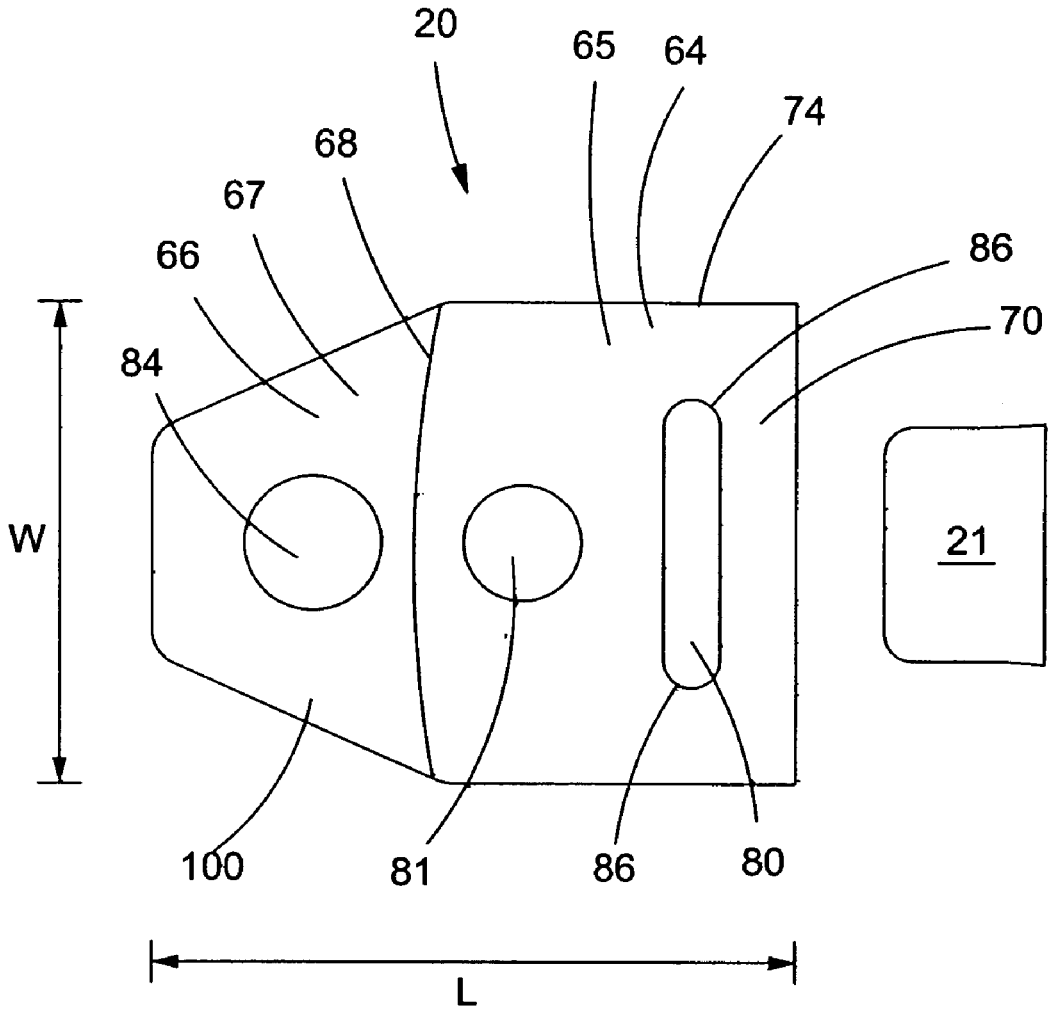
FIG. 3 shows a top plan view of the clip and cleat.

The first portion 64 defines a web cutout 80 that is a generally the shape of a rectangle, but the shorter sides of the rectangle are rounded, as shown in FIGS. 1–3. The first portion 64 also defines a tent pole cutout 82 that comprises a circular shape. The tent pole cutout 82 may comprise a diameter of about 0.375 inches, but in other embodiments, this diameter may be varied to accommodate differently sized tent poles. The first portion 64 further comprises a web wrapping portion 70 adjacent to the web cutout 80, as shown in FIGS. 1–3. The second portion 66 defines a guy rope cutout 84 that comprises a circular shape, as shown in FIGS. 1–6. The guy rope cutout 84 may comprise a diameter of about 0.88 inches, but in other embodiments, this diameter could be differently sized to accommodate differently sized guy ropes 26.

Method of Making the Cleat

In an embodiment, the cleat 20 is made from a piece of cold rolled steel. The piece of steel is stamped, and the first portion 64 that comprises the rectangular shape 65, and the second portion 66 that comprises the trapezoidal shape 67 are stamped out of the piece of steel. The act of stamping also stamps the web cutout 80 and the tent pole cutout 82 into the first portion 64, and the guy rope cutout 84 in the second portion 66. At this point, because there is no bend 68, and the first portion 64 and the second portion 66 are coplanar, and the first wall 72 and second wall 74 are each planar. The edges, commonly indicated by reference number 88 in the figures, of the web cutout 80, tent pole cutout 82, and guy rope cutout 84 are smooth after the stamping process. This is better than the cast cleat of the past, wherein the edges of the cast cutouts had rough, jagged projections that undesirably cut into and ruined the guy rope 26 and canopy web 24.

Next, the stamped piece of steel is placed in a steel bending machine. The steel is bent to form the body 100. The body 100 is formed so first side wall 72 is folded in upon itself at the bend 68, as shown in FIGS. 4 and 8. In other words, the first portion 64 is bent at an angle with respect to the second portion 66. The angle of the bend 68 in this example is about 155 degrees, as shown in FIGS. 4 and 8. As previously described, in other embodiments, this angle may be varied. At this point, the body 100 is ready for installation in a tent 25. It is noted that after bending, the first portion 64 and second portion 66 are each still planar, but they are no longer coplanar because of the bend 68, and the first side wall 72 and the second side wall 74 are no longer planar after bending.

Use of the Cleat in Erection of Tent

Figure 9:
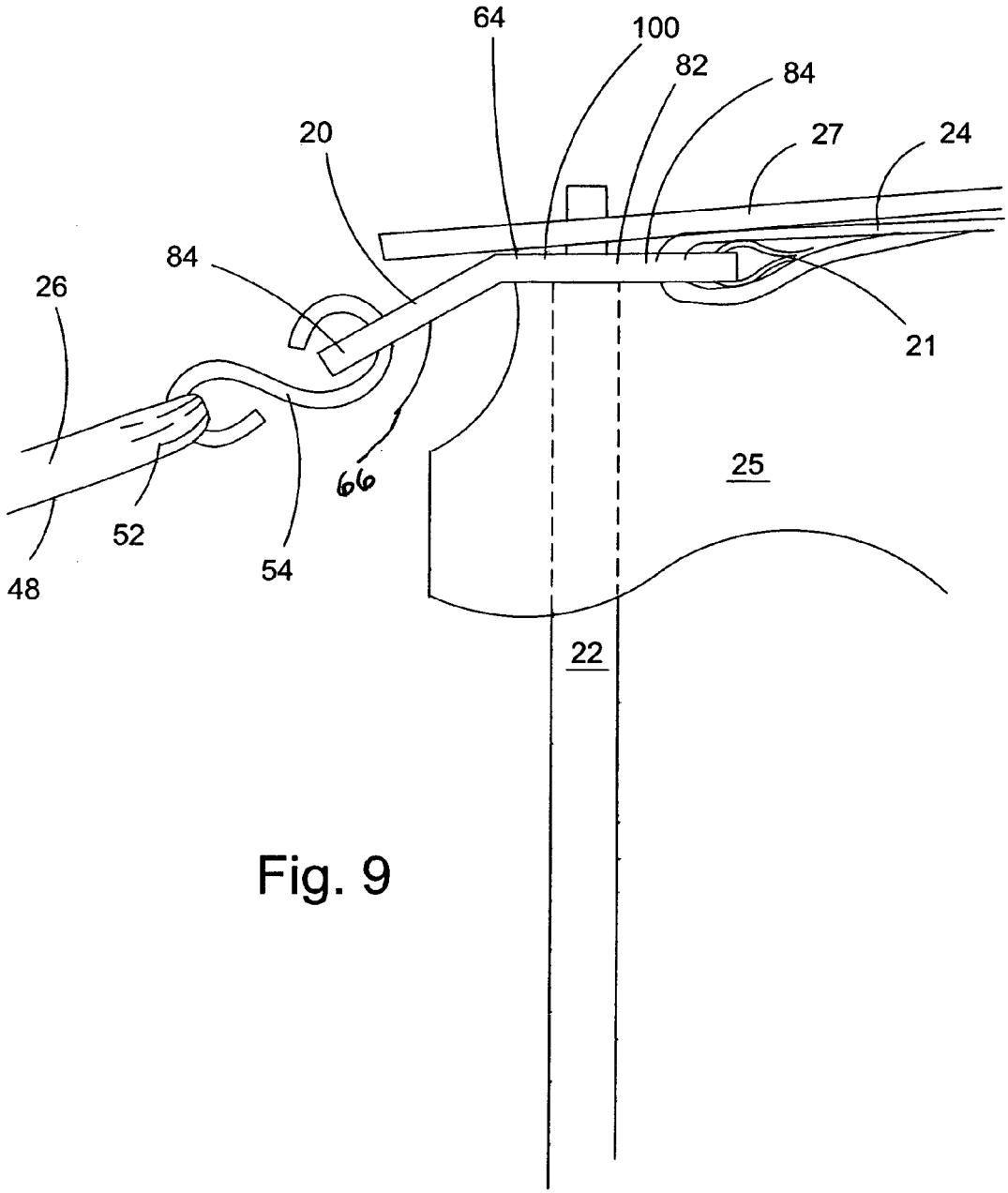
FIG. 9 shows an enlarged side elevational view of the cleat of FIGS. 7 and 8 installed in a tent.
Figure 10:
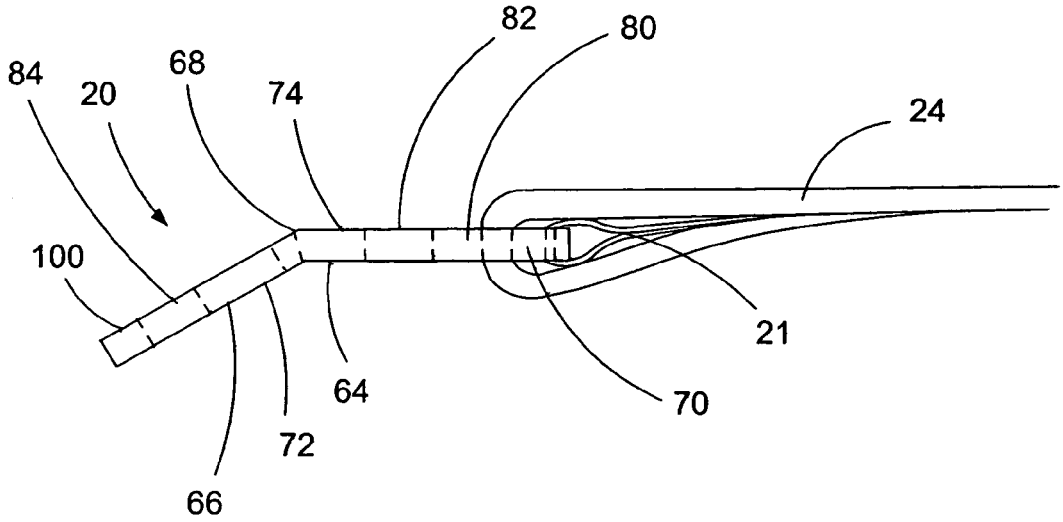
FIG. 10 shows a side elevational view of the cleat connected to the canopy web.
Figure 11:
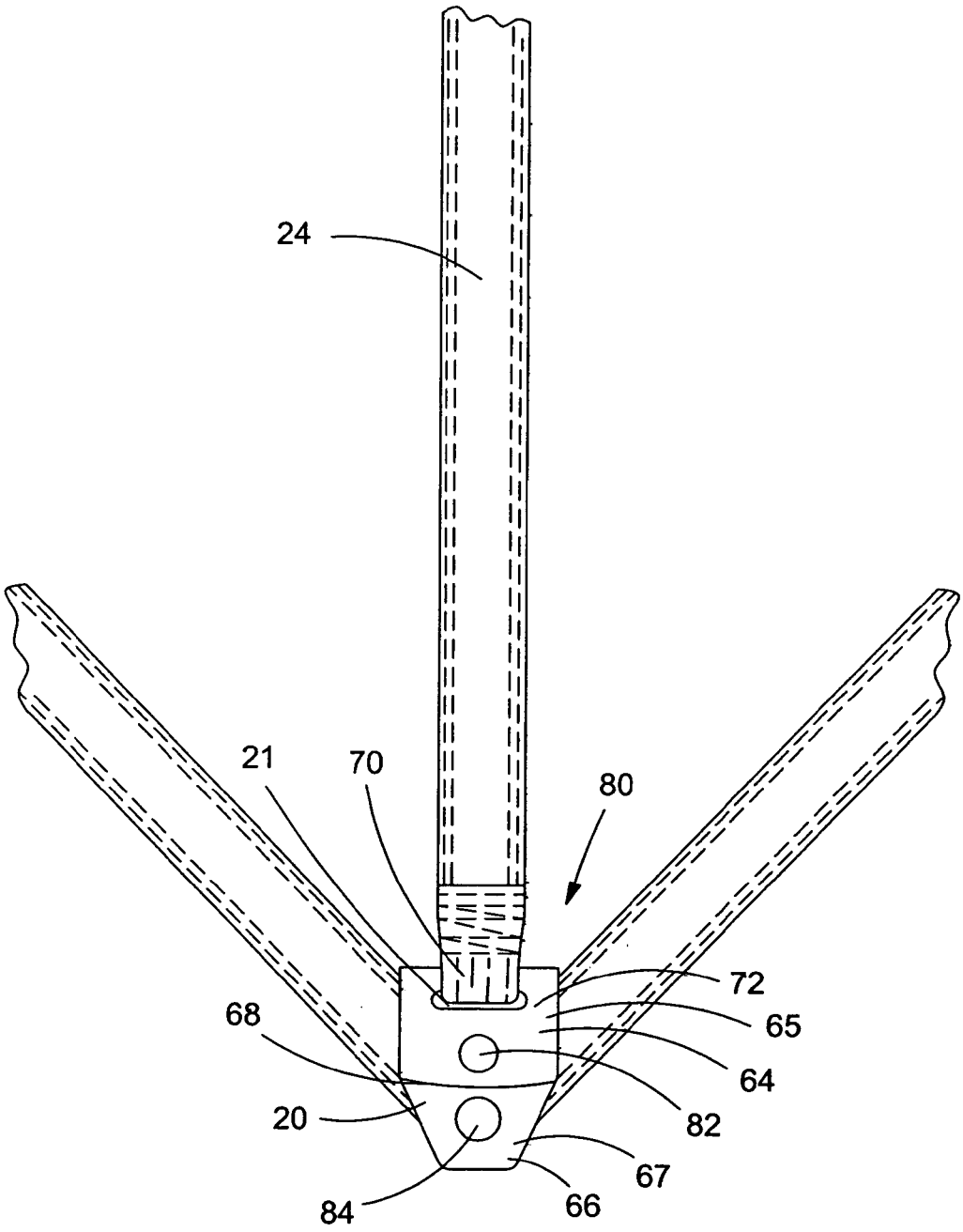
FIG. 11 shows a diagrammatic view of the cleat installed in a tent.

Reference is now made to FIGS. 7 and 8. FIG. 7 shows a diagrammatic view of the tent 25 using a cleat 20, and FIG. 8 shows and exploded view of the cleat 20, guy rope 26, pole 22, and canopy web 24. FIG. 9 shows an enlarged side elevational view of the cleat of FIG. 7 installed in a tent, and FIG. 10 shows a view of the connection between the cleat 20 and the canopy web 24. FIG. 11 shows a view further illustrating how the cleat 20 is installed in a tent 25, but the tent pole 22 and guy wire 26 are not shown for purposes of clarity. It is noted that the cleat 20 may come to the user pre-attached to the tent 25 canopy web 24.

Prior to installing the cleat 20 in the tent, the user moves the clip 21 around the web wrapping portion 70, such that it surrounds the web wrapping portion 70. At the same time the clip 21 is received in the web cutout 80 defined in the first portion 64, as shown in FIG. 8. The clip 21 may comprise plastic, metals, sheet metal, or combinations thereof, and one of its purposes is to prevent the canopy web 24 from wearing out against the web wrapping portion 70. This prolongs the lifespan of the canopy web 24 and the tent canopy 27. The canopy web 24 is then moved around and secured to the web wrapping portion 70. The clip 21 is thus captured between the web wrapping portion 70 and the canopy web 24, and it prevents the canopy web 24 from contacting and being damaged by the web wrapping portion 70.

Figure 12A:
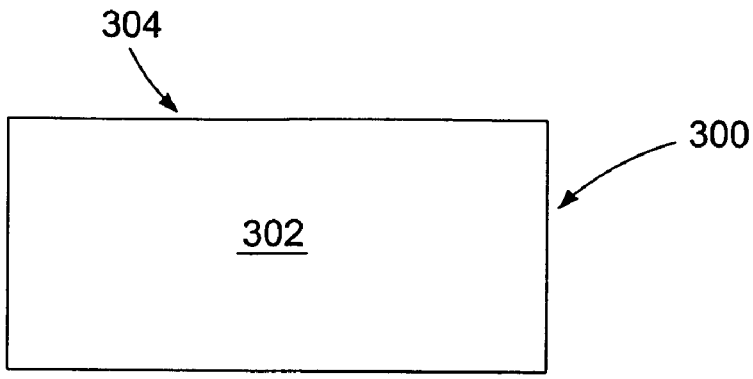
FIG. 12A shows a side elevational view of the second embodiment of the clip.
Figure 12B:
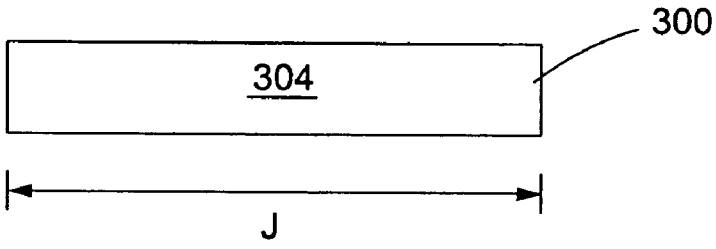
FIG. 12B shows a top view of the second embodiment of the clip.
Figure 12C:
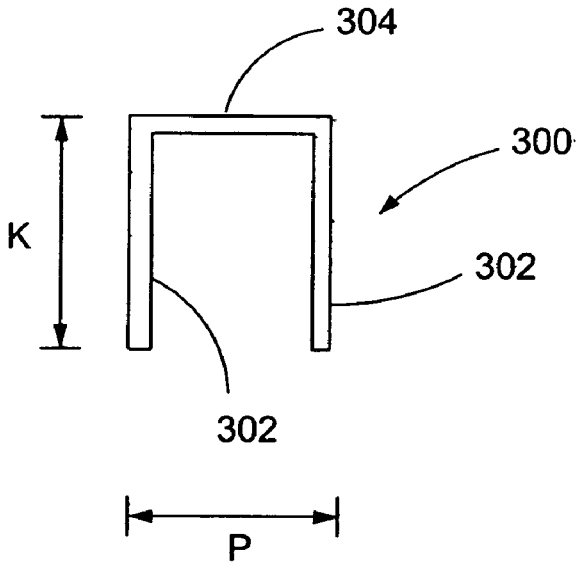
FIG. 12C shows an end view of the second embodiment of the clip.

FIGS. 12A, 12B, and 12C shows another embodiment of the clip 21. Here the clip 21 comprises a body 300 comprising planer side walls 302, and a planar top 304. The length of the planar top 304, designated J in FIG. 12B, is about 1.8 inches. The length, designated K in FIG. 12C of the planar sidewall 302, is about 0.56 inches. Lastly, the width, designated P in FIG. 12C, of the body 300 may be about 0.20 inches of course, in other embodiments all of these dimensions may be differently sized. The body 300 may comprise sheet metal, sheet steel, or plastic.

The tent pole 22 is then moved through the tent pole cutout 82 in the first portion 64 of the cleat 20. In particular, the tent pole 22 is moved through the cleat 20 in such a manner that it first approaches the first side wall 72 of the cleat 20. Then, it is moved through the first side wall 72 of the cleat 20, and passes out the second side wall 74 of the cleat 20. The movement of the tent pole 22 stops when the stop surface 23 of the pole 22 contacts the first side wall 72 of the body 100, as shown in FIG. 8. The hook 54 at the hook end 52 of the second rope 48 is moved into the guy rope cutout 84, and the ratchet end 50 of the second rope 48 is connected to the ratchet 28. At this point, the first end 42 of the first rope 40 is attached to the ground stake 44, and its second end 46 is fed into the ratchet 28. The user then begins moving the handle 29 of the ratchet 28 back and forth in the direction of arrow A—A, shown in FIG. 7, to draw the slack out of the first rope 40. The taken up slack is indicated by reference number 47 in FIG. 7.

The slack is taken up by the user moving the handle 29 of the ratchet 28 back and forth until the guy rope 26 is sufficiently taught. The user can gauge when to stop taking up slack by assessing how taught the guy rope 26 is and visually assessing the tent canopy 27. If the user errors and begins to take too much slack out of the guy rope 26, the above-described structure of the cleat 20 prevents its catastrophic failure, because it can safely handle excessive loads imposed by the ratchet 28. Thus, the cleat 20 allows ratchets 28 to be used to draw slack out of guy ropes 26 without the risk of the cleat 20 unpredictable snapping or breaking.

Also, as shown in FIG. 9, the bend 68 in the cleat 20 allows the second portion 66, the canopy 27 of the tent 25, and the guy rope 26 to be substantially in line. This alignment decreases the likelihood the cleat 20 will snap as slack is drawn out of the guy rope 26, because the forces exerted on the cleat from the guy rope 26 are substantially linear. In other words, the alignment decreases deleterious bending moments from being applied to the cleat 20, thus decreasing the likelihood the cleat 20 will fail.

It is noted that the guy rope 26 could be embodied as nylon strap, steel wire, steel cable, and other materials capable of withstanding the loads imposed by the ratchet 28. Also, the cleat 20 could be installed in tents wherein there is no ratchet 28 attached to the guy rope 26. In that embodiment, the guy rope 26 shown in FIG. 8 would be a single rope attached directly from the cleat 20 to the ground stake 44. Thus, the cleat 20 is very versatile in that it can be used in any tent, regardless of whether a ratchet 28 is used to draw slack out of the guy rope 26 or a team of workers pull the slack out of the guy rope 26. In other words, the cleat 20 may be used in a tent that has no ratchet 28 attached to the guy rope 26.

It will be appreciated by those skilled in the art that while the cleat 20 has been described above in connection with particular embodiments and examples, the cleat 20 is not necessarily so limited and that other embodiments, examples, uses, modifications, and departures from the embodiments, examples and uses may be made without departing from the cleat 20, and all these other embodiments are intended to come within the scope of the claims.

What is claimed:

1. An assembly comprising:

a) a cleat comprising a body comprising a first side wall, a second side wall, a surrounding side wall extending between the first side wall and second side wall, and a bend in the body such that the first side wall is partly folded in on itself;

b) a tent canopy having a web, a tent pole used for supporting the tent canopy, and a guy rope used for stabilizing the tent canopy, c) a web cutout defined in the body and used for receiving the web of the tent, a tent pole cutout defined in the body and used for receiving the tent pole, and a guy rope cutout defined through the body used for receiving the guy rope;

d) a web wrapping portion formed adjacent to the web cutout; and e) the assembly further comprising a clip, the clip fitted about the web wrapping portion and the clip received in the web cutout, the clip for preventing a canopy web of a tent from wearing out when the cleat is attached to the canopy web and the tent pole is received in the tent pole cutout such that the tent pole supports the cleat and tent canopy above the ground.

2. The clip of claim 1 wherein the clip comprises flat sidewalls, a flat top, and comprises plastic, metal, and combinations thereof.

3. An erected tent comprising:

a) a cleat comprising a body;

b) the body comprising a first portion that defines a rectangular shaped web cutout and a tent pole cutout, and a second portion that defines a guy rope cutout, such that the tent pole cutout is positioned between the web cutout and guy rope cutout, and the first portion is planar and the second portion is planar;

c) the body comprising a bend where the first portion and the second portion meet, the first portion and second portion folded towards one another at the bend so that the first portion and second portion are not coplanar;

d) the first portion further comprising a web wrapping portion;

e) a guy rope, a tent pole, a ratchet mechanism, and a canopy web;

f) wherein the tent pole is fitted in the tent pole cutout, and the canopy web is fastened to the web wrapping portion;

g) wherein the guy rope comprises a first rope having a first end connected to a ground stake secured in the ground and a second end connected to the ratchet mechanism, and wherein the guy rope further comprises a second rope having a ratchet end connected to the ratchet mechanism and having a hook end, a hook is connected to the hook end and the hook is hooked to the guy rope cutout in the body and wherein the ratchet mechanism is used for drawing slack out of the guy rope;

h) wherein the body and the canopy web are supported above the ground stake by the tent pole; and i) the body comprises a non-cast metal.

4. The erected tent according to claim 3 wherein the non-cast metal comprises cold rolled steel.

* * * * *